US010022688B2

(12) United States Patent
Keeton, Jr.

(10) Patent No.: US 10,022,688 B2
(45) Date of Patent: Jul. 17, 2018

(54) COMBINATION SUBMERSIBLE AND FLOATING AERATOR

(75) Inventor: Jimmie A. Keeton, Jr., Ft. Collins, CO (US)

(73) Assignee: KEETON INDUSTRIES, Wellington, CO (US)

( * ) Notice: Subject to any disclaimer, the term of this patent is extended or adjusted under 35 U.S.C. 154(b) by 849 days.

(21) Appl. No.: 13/462,793

(22) Filed: May 2, 2012

(65) Prior Publication Data

US 2013/0292858 A1 Nov. 7, 2013

(51) Int. Cl.

| | |
|---|---|
| ***B01F 13/10*** | (2006.01) |
| ***B01F 15/00*** | (2006.01) |
| ***B01F 3/04*** | (2006.01) |

(52) U.S. Cl.

CPC ..... *B01F 13/1025* (2013.01); *B01F 3/04241* (2013.01); *B01F 3/04517* (2013.01); *B01F 3/04773* (2013.01); *B01F 15/00253* (2013.01); *B01F 15/00558* (2013.01); *B01F 3/0473* (2013.01)

(58) Field of Classification Search

CPC ..... B01F 2003/0468; B01F 7/1625; B01F 13/1025; B01F 3/04773; B01F 3/04517; B01F 3/047241; B01F 15/00253; B01F 15/00558; B01F 3/0473; C02F 3/16

USPC ..... 261/93

See application file for complete search history.

(56) References Cited

U.S. PATENT DOCUMENTS 2,054,395 A * 9/1936 Streander ..... B01F 3/04773 210/194
2,186,371 A * 1/1940 Durdin, Jr. ..... B01D 21/2433 210/703
2,827,268 A * 3/1958 Staaf ..... B01F 3/0853 210/170.09
3,066,921 A * 12/1962 Thommel ..... B01F 3/04539 261/30

(Continued)

FOREIGN PATENT DOCUMENTS

CN 2737788 Y * 11/2005
CN 101508493 A * 8/2009

(Continued)

OTHER PUBLICATIONS

Chaloux "Flexible Membrane vs Ceramic Diffusers: Who's Winning?" published by Frost and Sullivan Market Insight on Jan. 18, 2001.*

(Continued)

*Primary Examiner* — Amber R Orlando
*Assistant Examiner* — Stephen Hobson
(74) *Attorney, Agent, or Firm* — William W. Cochran; Cochran Freund & Young LLC

(57) ABSTRACT

An aeration system may have a submersible aerator that may be located on the bottom of a body of water and a floating aerator that may operate directly above the submersible aerator. The submersible aerator may create a laminar column of bubbles and may be powered by an air compressor. The floating aerator may use a motor driven propeller to agitate water on the water surface. A controller may determine when to operate the aerators, and may operate them (Continued)

separately or together in some instances. Some embodiments may have a controller that operates the aerators differently based on energy supply, which may vary in solar powered systems with a battery bank.

5 Claims, 6 Drawing Sheets

(56) References Cited

U.S. PATENT DOCUMENTS 3,228,526 A * 1/1966 Ciabattari ..... B01F 3/04517 210/195.1
3,521,864 A * 7/1970 Welles, Jr. ..... B01F 3/04773 210/219
3,573,203 A * 3/1971 Kaelin ..... B01F 3/04773 210/219
3,628,775 A * 12/1971 McConnell ..... B01F 3/04517 210/220
3,664,647 A * 5/1972 Snow ..... 261/30
3,682,313 A * 8/1972 Abraham ..... B01F 3/04773 210/195.3
3,724,667 A * 4/1973 McKinney ..... B01F 3/0473 210/195.3
3,796,417 A * 3/1974 Kaelin ..... 261/93
3,814,395 A * 6/1974 Kaelin ..... B01F 3/04539 261/87
3,865,721 A * 2/1975 Kaelin ..... B01F 3/04609 210/195.1
3,910,838 A * 10/1975 Kaelin ..... B01F 3/04099 210/627
3,911,065 A * 10/1975 Martin ..... B01F 3/04773 261/120
3,979,294 A * 9/1976 Kaelin ..... C02F 3/12 210/195.3
4,021,349 A * 5/1977 Kaelin ..... C02F 3/205 210/219
4,030,859 A * 6/1977 Henegar ..... 417/61
4,140,737 A * 2/1979 Hauser ..... A01C 3/026 209/169
4,159,243 A * 6/1979 Okey ..... C02F 3/006 210/199
4,268,398 A * 5/1981 Shuck ..... B01F 3/04765 111/101
4,374,030 A * 2/1983 Franklin, Jr. ..... B01F 3/04609 210/164
4,775,467 A * 10/1988 Calltharp ..... C02F 1/006 210/142
4,906,359 A * 3/1990 Cox, Jr. ..... B01F 3/0412 210/170.02
5,071,550 A * 12/1991 Bernhardt ..... C02F 3/20 210/242.2
5,227,067 A * 7/1993 Runyon ..... B01F 3/0473 210/143
5,295,059 A * 3/1994 Brooks ..... G05B 19/05 700/18
6,032,931 A * 3/2000 Plunkett ..... B01F 3/04517 210/220
6,083,405 A * 7/2000 Tanaka ..... C02F 1/28 210/170.05
6,439,853 B2 * 8/2002 Tormaschy ..... B01F 3/04773 210/170.05
7,713,031 B2 * 5/2010 Dane ..... F04B 19/04 114/331
8,512,561 B2 * 8/2013 Al-Anzi ..... B01F 3/04248 210/121
9,290,398 B2 * 3/2016 Burton ..... C02F 1/74
2002/0104807 A1 * 8/2002 Keeton, Jr. ..... 210/747
2005/0007042 A1 * 1/2005 Moore ..... A01B 45/02 318/139
2007/0233420 A1 * 10/2007 Potucek ..... E04H 4/129 702/130
2009/0206497 A1 * 8/2009 Nelson ..... B01F 3/04595 261/36.1
2009/0321369 A1 * 12/2009 Galletta, Jr. ..... B01F 3/04765 210/758
2012/0228216 A1 * 9/2012 Gavrieli ..... C02F 3/08 210/615
2015/0108054 A1 * 4/2015 Bleth ..... B01F 3/04517 210/170.09

FOREIGN PATENT DOCUMENTS

CN 201678529 U * 12/2010
DE 1584898 A1 * 2/1970 ..... B01F 3/0473
DE 2225468 A1 * 12/1972 ..... B01F 3/04773
EP 0415403 A1 * 3/1991 ..... B01F 3/0473
GB 1428349 A * 3/1976
GB 1428349 A * 3/1976 ..... B01F 3/04609
GB 1512225 A * 5/1978 ..... A01K 63/042
SU 1344741 A1 * 10/1987 ..... B01F 3/04609

OTHER PUBLICATIONS

LaMonica "Thinking about solar? It's easier to start small" published by CNET on Aug. 30, 2010.*
WikiBooks <https://web.archive.org/web/20071029131833/http://en.wikibooks.org/wiki/Battery_Power/Lithium_Ion_Batteries>. Captured Oct. 29, 2007 on Internet Archive.*
123 Ponds <https://web.archive.org/web/20110425015558/http://www.123ponds.com/l3pvc5-1.html> captured Apr. 25, 2011 on Internet Archive.*
Wellington "Electric Motor Technology" published Aug. 2006.*
Dusterloh Fluidtechnik "Pneumatic gearwheel motors" published Aug. 2010.*
Li et al. "An overview of non-volatile memory technology and the implication for tools and architectures" in Design, Automation & Test in Europe Conference & Exhibition published 2009.*
Blake et al. "A survey of multicore processors" IEEE Signal Processing Magazine published Nov. 2009.*

* cited by examiner

COMBINATION SUBMERSIBLE AND FLOATING AERATOR

BACKGROUND

Aeration systems are used to increase the oxygen saturation of a body of water. These systems are generally used in bodies of water that have anoxic conditions where an increase in oxygen saturation improves the health of the body of water. Aeration systems have been used to clean bodies of water such as ponds, lakes, lagoons, waste water systems, aquaculture systems, and sewage systems.

SUMMARY

An aeration system may have a submersible aerator that may be located on the bottom of a body of water and a floating aerator that may operate directly above the submersible aerator. The submersible aerator may create a laminar column of bubbles and may be powered by an air compressor. The floating aerator may use a motor driven propeller to agitate water and increase oxygen transfer rate efficiency on the water surface. ASCE certified efficiency for the surface aerator is 2.37 lbs. oxygen/HP/Hr. and may vary in size and horsepower dependent upon application. A controller may determine when to operate the aerators, and may operate them separately or together in some instances. Some embodiments may have a controller that operates the aerators based on energy supply, which may vary in solar powered systems with a battery bank.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1:
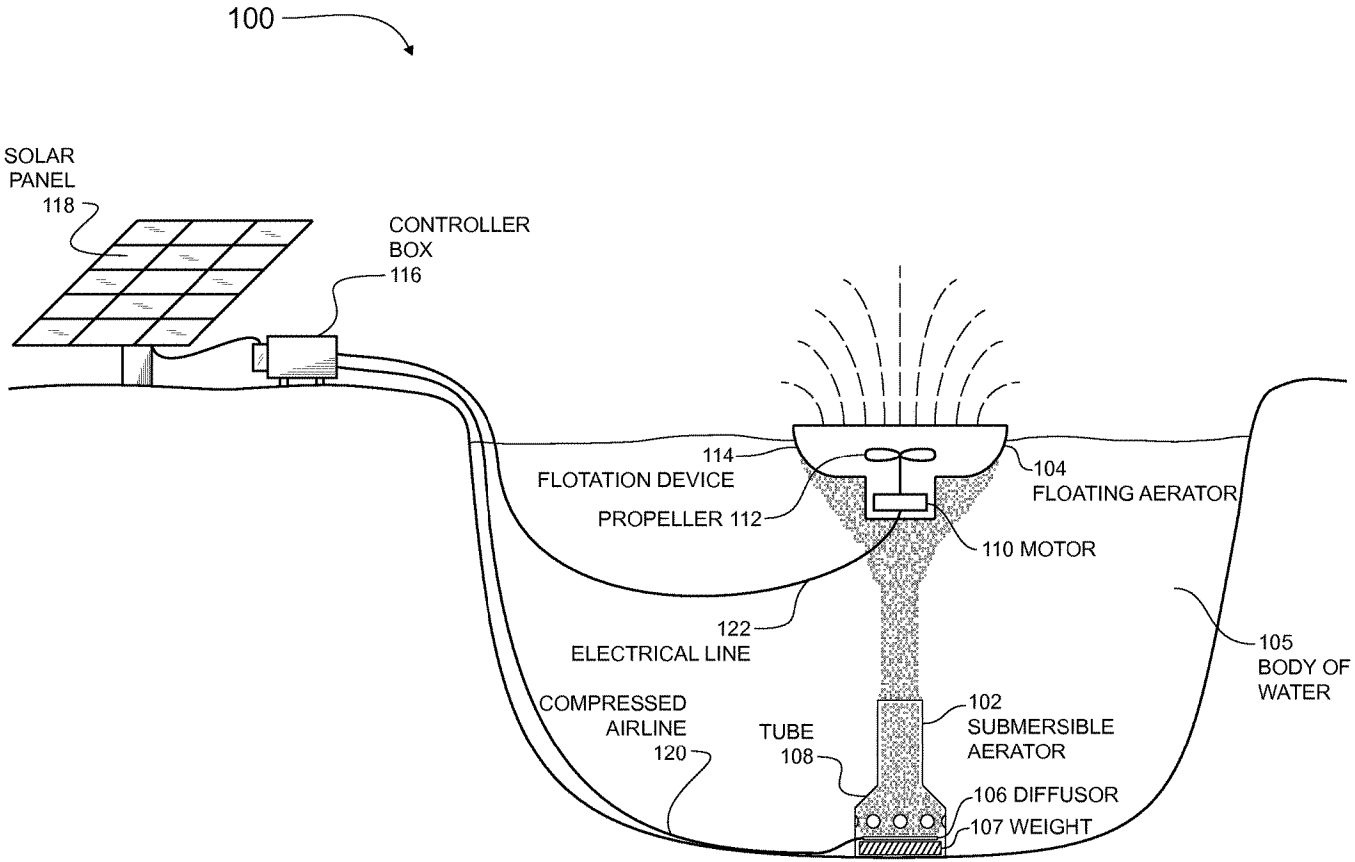
FIG. 1 is a diagram illustration of an embodiment showing a two aerator system.

A liquid aeration system may use a submersible aerator and a floating aerator where the floating aerator may be positioned above the submersible aerator. The combination of a submersible aerator that moves water from the bottom and a floating aerator may circulate and aerate the full depth of a body of water. In many instances where water at the bottom of the water body is cold, the system may pull cold water from the bottom, aerate the water, and the cold water may fall to the bottom again, completing the circulation.

The submersible aerator may aerate a bottom portion of the body of water. To aerate the bottom portion, the submersible aerator may generate a column of bubbles that cause water to flow upward. The submersible aerator may have a diffusor that may create small bubbles. Some diffusers may have a venturi tube that pulls water from the bottom of the body of water into the bubble stream. In many embodiments, the air pressure applied to the diffuser may be low enough that the rising bubble stream is laminar flow as opposed to turbulent or slug flow. As the bubble stream rises, it forms a column of bubbles moving water to the surface.

The floating aerator may aerate an upper portion of the body of water. To aerate the upper portion, the floating aerator may agitate the upper portion of water. The floating aerator may further aerate the water in the bubble column by propelling it upwards, above the surface of the water so that it splashes and aerates. The propeller on the surface unit pumps water and breaks it into a thinner film to pick up oxygen and transfer oxygen to the pumped water stream.

The floating aerator may stay within the bubble column produced by the submersible aerator. To keep the floating aerator within the bubble column, the floating aerator may be anchored to a bottom of the body of water. For example, a heavy object may be used to anchor the floating aerator. In another example, stakes may be anchored in the banks of the body of water to keep the floating aerator in position. Some embodiments may mount the submersible aerator below the floating aerator by mechanically connecting the two aerators together. In one example, the submersible aerator may be suspended from the floating aerator.

A controller may be used in conjunction with the submersible aerator and floating aerator. The controller may determine when to operate the submersible aerator and the floating aerator. For instance, if the submersible aerator consumes less energy than the floating aerator, then the controller may operate the submersible aerator for longer periods of time than the floating aerator. The controller may determine how much energy is available to the system and adjust the amount of time the floating aerator and submersible aerator are operated. A controller and remote probes that monitor Dissolved Oxygen may use single or multiple points to control on/off cycling of the aerators based upon dissolved oxygen readings. Data is relayed to the controller to cycle subsurface or surface aerator.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

The subject matter may be embodied as devices, systems, methods, and/or computer program products. Accordingly, some or all of the subject matter may be embodied in hardware and/or in software (including firmware, resident software, micro-code, state machines, gate arrays, etc.) Furthermore, the subject matter may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be for example, but not limited to, an electronic, magnetic, optical, electromagnetic, infrared, or semiconductor system, apparatus, device, or propagation medium. By way of example, and not limitation, computer-readable media may comprise computer storage media and communication media.

Computer storage media includes volatile and nonvolatile, removable and non-removable media implemented in any method or technology for storage of information such as computer-readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and may be accessed by an instruction execution system. Note that the computer-usable or computer-readable medium can be paper or other suitable medium upon which the program is printed, as the program can be electronically captured via, for instance, optical scanning of the paper or other suitable medium, then compiled, interpreted, of otherwise processed in a suitable manner, if necessary, and then stored in a computer memory.

Communication media typically embodies computer-readable instructions, data structures, program modules or other data in a modulated data signal such as a carrier wave or other transport mechanism and includes any information delivery media. The term "modulated data signal" can be defined as a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above-mentioned should also be included within the scope of computer-readable media.

When the subject matter is embodied in the general context of computer-executable instructions, the embodiment may comprise program modules, executed by one or more systems, computers, or other devices. Generally, program modules include routines, programs, objects, components, data structures, and the like, that perform particular tasks or implement particular abstract data types. Typically, the functionality of the program modules may be combined or distributed as desired in various embodiments.

FIG. 1 is a diagram of an embodiment 100, showing a liquid aeration system that may have a submersible aerator and a floating aerator. Embodiment 100 is an example of an aeration system that may circulate and aerate the full depth of a body of water.

The liquid aeration system 100 may have a submersible aerator 102 and a floating aerator 104. The combination submersible aerator 102 and floating aerator 104 may be used to improve water quality in a body of water 105. To aerate the body of water 105, the floating aerator 104 may be positioned above the submersible aerator 102.

The submersible aerator 102 may aerate water located at a bottom of the body of water 105. Generally, the submersible aerator 102 may be located on a bottom surface of the body of water 105. When the submersible aerator 102 is placed at the bottom, the full depth of the body of water may be circulated.

The submersible aerator 102 may have a diffusor 106, a weight 107 and a tube 108. The submersible aerator 102 may use the diffusor 106 to generate a column of bubbles and the tube 108 to pull water into the bubble stream. The column of bubbles may have a diameter that is similar in size to the tube 108.

The weight 107 may be used to keep the submersible aerator 102 stable and submerged in the body of water 105.

The diffusor 106 may be one of several types of diffusors. One type of bubble diffusor may use an expandable membrane diffusor made of rubber. Other types of diffusors may include ceramic, alumina silicate, EPDM (Ethylene Propylene Diene Monomer), rubber membrane or metal stone diffusors.

The submersible aerator 102 may be connected to a compressor (not shown in FIG. 1). The compressor may provide air to the diffusor 106 via a compressed airline 120. The compressed airline 120 may be connected to the diffusor 106. Depending on the air pressure provided by the compressor, the diffusor 106 may produce a laminar flow of bubbles. At higher pressures, the diffusor 106 may produce turbulent or slug flow. The compressed airline 120 may be of sufficient weight to be submerged in the body of water 105.

The tube 108 may be used to pull water into the bubble stream created by the diffusor 106. The tube 108 may act as a venturi tube. The combination of the diffusor 106 and venturi tube 108 may create a laminar column of water that draws water from the bottom of the tube.

The length and diameter of the tube 108 may be varied in different embodiments of the submersible aerator 102. For instance, one embodiment may have an internal diameter of four inches for the tube 108. Other embodiments may have tube diameters that are less than or greater than four inches. Some embodiments may have tube diameters of 6, 8, 10, 12, 18, or more inches.

The length of the tube 108 may also be changed in different embodiments of a submersible aerator 102. For instance, the length of the tube may be two times the width of the tube. Other embodiments may have tube lengths that are 3, 4, 5, 8, 10, or more times the width of the tube.

The floating aerator 104 may aerate on the surface of a body of water. The floating aerator 104 may be located above the submersible aerator 102. By placing the floating aerator 104 above the submersible aerator 102, cold water pushed upward by the submersible aerator 102 may be agitated by the floating aerator 104. The aerated cold water may then flow back to the bottom of the body of water 105, thus circulating and aerating the full depth of the body of water 105.

The floating aerator 104 may have a motor 110 used to rotate a propeller 112. The motor 110 may be an electric motor of varying horsepower (hp). Alternatively, the motor 110 may be operated by the air compressor. Depending on the size of the body of water 105, the motor 110 may be a ¼ hp, ½ hp, ¾ hp, and/or 1 hp motor. In some applications, the motor 110 may be smaller than ¼ hp or larger than 1 hp. The propeller 112 may force water above the surface of the body of water 105. Many surface aerators may produce a fountain or splashing effect above the surface of the water. Depending on the application, the propeller 112 may be of varying sizes. The propeller 112 may be sized based on the size of the motor 110 and the size of the body of water 105. For instance, a 1 horsepower motor may use a 6 inch propeller.

A flotation device 114 may be used to keep the motor 110 and propeller 112 afloat. The flotation device 114 may have a buoyancy to keep the motor 110 and propeller 112 near the surface of the body of water 105.

The propeller 112 may be located at a certain depth that allows the propeller 112 to pull water from below the surface of the body of water 105.

A draw tube may be attached to the floating aerator 104. The draw tube may pull water from a lower portion of the water body to be aerated. The length of the draw tube may be varied depending on the application. Draw tubes of various lengths may be used to pull water from various depths to force circulation.

The liquid aeration system 100 may also have one or more solar panels 118 and a controller box 116. The solar panel 118 may be used to capture solar energy and convert the energy into electricity, which may be stored in batteries. The number of solar panels may be adjusted based on the energy consumption of the system 100. For instance, if the system 100 requires large amounts of energy, multiple solar panels may be implemented.

The controller box 116 may house the compressor, a controller and a battery bank. The solar panel 118 may be used to charge the battery bank. If the solar panel 118 is not generating electricity, the battery bank may power the air compressor and floating aerator 104. To power the floating aerator 104, an electrical line 122 may connect the battery bank to the floating aerator 104. The controller connected to the solar panel 118 may determine how to distribute the electricity generated by the solar panel 118.

The battery bank may be used to power the system 100 when the solar panel 118 is not generating electricity. For instance, at night when the solar panel 118 would not be generating electricity, the system 100 may be powered by the battery bank. Similarly, when it is a cloudy day and the solar panel 118 is not generating sufficient electricity, the battery bank may be utilized.

An inverter may be used to convert direct current (DC) electricity to alternating current (AC) electricity. The inverter may be used to convert the direct current generated by the solar panel 118 into alternating current. For instance, the motor 110 may use an AC power source. To minimize the footprint of the system 100, the inverter may be housed in the controller box 116.

The controller may determine when to operate the submersible aerator 102 and the floating aerator 104. For instance, if the submersible aerator 102 consumes less energy than the floating aerator 104, the controller may operate the submersible aerator 102 for longer periods of time than the floating aerator 104.

The controller may determine how much power is available to the system 100 and adjust the amount of time the submersible aerator 102 and floating aerator 104 are operated. For example, if there is a low supply of energy, the controller may operate the floating aerator 104 for a portion of the time the submersible aerator 102 is operated. In another example, the controller may operate the submersible aerator 102 continuously while operating the floating aerator 104 intermittently.

In addition to the submersible aerator 102 and floating aerator 104, the system 100 may also have one or more directional circulators, which may be paddlewheels, airlifts, or other circulators. The circulators may be used to stir or move the body of water 105 in the flatwise direction. For example, two circulators may be used to circulate the body of water 105 in a clockwise or counterclockwise direction as viewed from above. The lateral circulation may help to further aerate the body of water 105.

The combination submersible aerator 102 and floating aerator 104 may be used to improve water quality in a body of water. The system may be used in wastewater lagoons/ponds, aquaculture systems, reservoirs, water storage tanks, fish/shellfish tanks, artificial ponds/lakes, natural bodies of water, etc.

Figure 2:
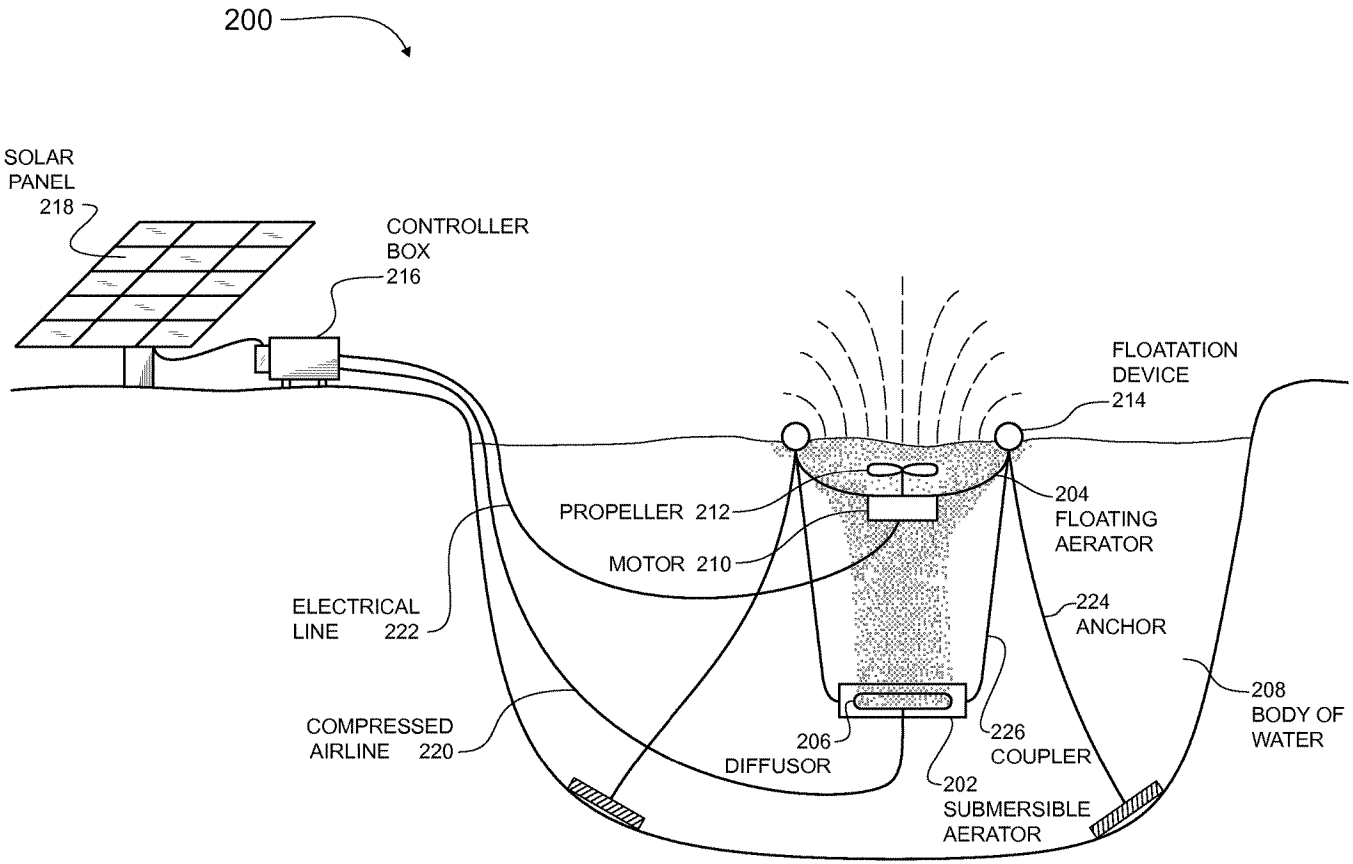
FIG. 2 is a diagram illustration of an embodiment showing an alternative two aerator system.

FIG. 2 is a diagram of an embodiment 200, showing an alternative liquid aeration system that may have a submersible aerator and a floating aerator. Embodiment 200 is an example of an aeration system that may circulate and aerate a predetermined depth of a body of water.

The system 200 may have a submersible aerator 202 and a floating aerator 204. The combination submersible aerator 202 and floating aerator 204 may be used to improve water quality in a body of water 208. To aerate the body of water 208, the floating aerator 204 may be positioned above the submersible aerator 202.

The submersible aerator 202 may aerate water located at a predetermined depth of a body of water 208. The submersible aerator 202 may be adjusted to varying depths of the body of water 208. Many bodies of water may have multiple layers or strata of water, and sometimes lower layers may be more anoxic than others. Anoxic water may be water that is depleted of dissolved oxygen. A user may determine at what depth the submersible aerator 202 will be positioned based on the location of anoxic water. When the submersible aerator 202 is placed at a predetermined depth, the system 200 may circulate and oxygenate the anoxic water.

The body of water 208 may be stratified. Stratification occurs when layers are formed in a body of water that act as barriers to water mixing. To aid in destratification, the submersible aerator 202 may be placed at or near stratification layers in the body of water 208. For instance, the submersible aerator 202 may be placed between two stratification layers. When the submersible aerator 202 is placed between the two layers, the system 200 may aid in destratification of the body of water 208.

The submersible aerator 202 may have a diffusor 206. The submersible aerator 202 may use the diffusor 206 to generate a column of bubbles.

The diffusor 206 may be one of several types of diffusors. One type of bubble diffusor may use an expandable membrane diffusor made of rubber. Other types of diffusors may include ceramic or metal stone diffusors.

The submersible aerator 202 may be connected to a compressor. The compressor may provide air to the diffusor 206 via a compressed airline 220. The compressed airline 220 may be connected to the diffusor 206. Depending on the air pressure provided by the compressor, the diffusor 206 may produce a laminar flow of bubbles. If the pressure is too high, the diffusor 206 may produce turbulent or slug flow. The compressed airline 220 may be of sufficient weight to be submerged in the body of water 208

The floating aerator 204 may aerate on the surface of a body of water. The floating aerator 204 may be located above the submersible aerator 202. By placing the floating aerator 204 above the submersible aerator 202, cold water pushed upward by the submersible aerator 202 may be agitated by the floating aerator 204. The aerated cold water may then flow back to the bottom of the body of water 208, thus circulating and aerating the full depth of the body of water 208.

The floating aerator 204 may have a motor 210 used to rotate a propeller 212. The motor 210 may be an electric motor of varying horsepower (hp). Alternatively, the motor 210 may be operated by the air compressor. Depending on the size of the body of water 208, the motor 210 may be a ¼ hp, ½ hp, ¾ hp, and/or 1 hp motor. In some applications, the motor 210 may be smaller than ¼ hp or larger than 1 hp.

The propeller 212 may force water above the surface of the body of water 208. Many surface aerators may produce a fountain or splashing effect above the surface of water. Depending on the application, the propeller 212 may be of varying sizes. The propeller 212 may be sized based on the size of the motor 210 and the size of the body of water 208. For instance, a 1 horsepower motor may use a 6 inch propeller.

A flotation device 214 may be used to keep the motor 210 and propeller 212 afloat. The flotation device 214 may have a buoyancy to keep the motor 210 and propeller 212 near the surface of the body of water 208. Any buoyant devices may be used to keep the floating aerator 204 afloat. For example, several buoys may be used.

The propeller 212 may be located at a certain depth that allows the propeller 212 to pull water from below the surface of the body of water 208.

To keep the system 200 in place, one or more anchors 224 may be used. The one or more anchors 224 may be connected to the floating aerator 204. Any heavy object may be used to anchor the submersible aerator 202 and floating aerator 204.

The submersible aerator 202 may be mechanically connected to the floating aerator 204. Any type of coupling mechanism may be used to connect the submersible aerator 202 to the floating aerator 204. For instance, a coupler 226 may be used to connect the submersible aerator 202 to the floating aerator 204. The coupler 226 may keep the floating aerator 204 situated above the submersible aerator 202.

The coupler 226 may be adjustable in length. The length of the coupler 226 may be varied to allow a user to place the submersible aerator 202 at a predefined depth.

The liquid aeration system 200 may also have one or more solar panels 218 and a controller box 216. The solar panel 218 may be used to capture solar energy and convert the energy into electricity, which may be stored in batteries. The number of solar panels may be adjusted based on the energy consumption of the system 200. For instance, if the system 200 uses large amounts of energy, multiple solar panels may be implemented.

The combination submersible aerator 202 and floating aerator 204 may be used to improve water quality in a body of water. The system may be used in wastewater lagoons/ponds, aquaculture systems, reservoirs, water storage tanks, fish/shellfish tanks, artificial ponds/lakes, natural bodies of water, etc.

Figure 3:
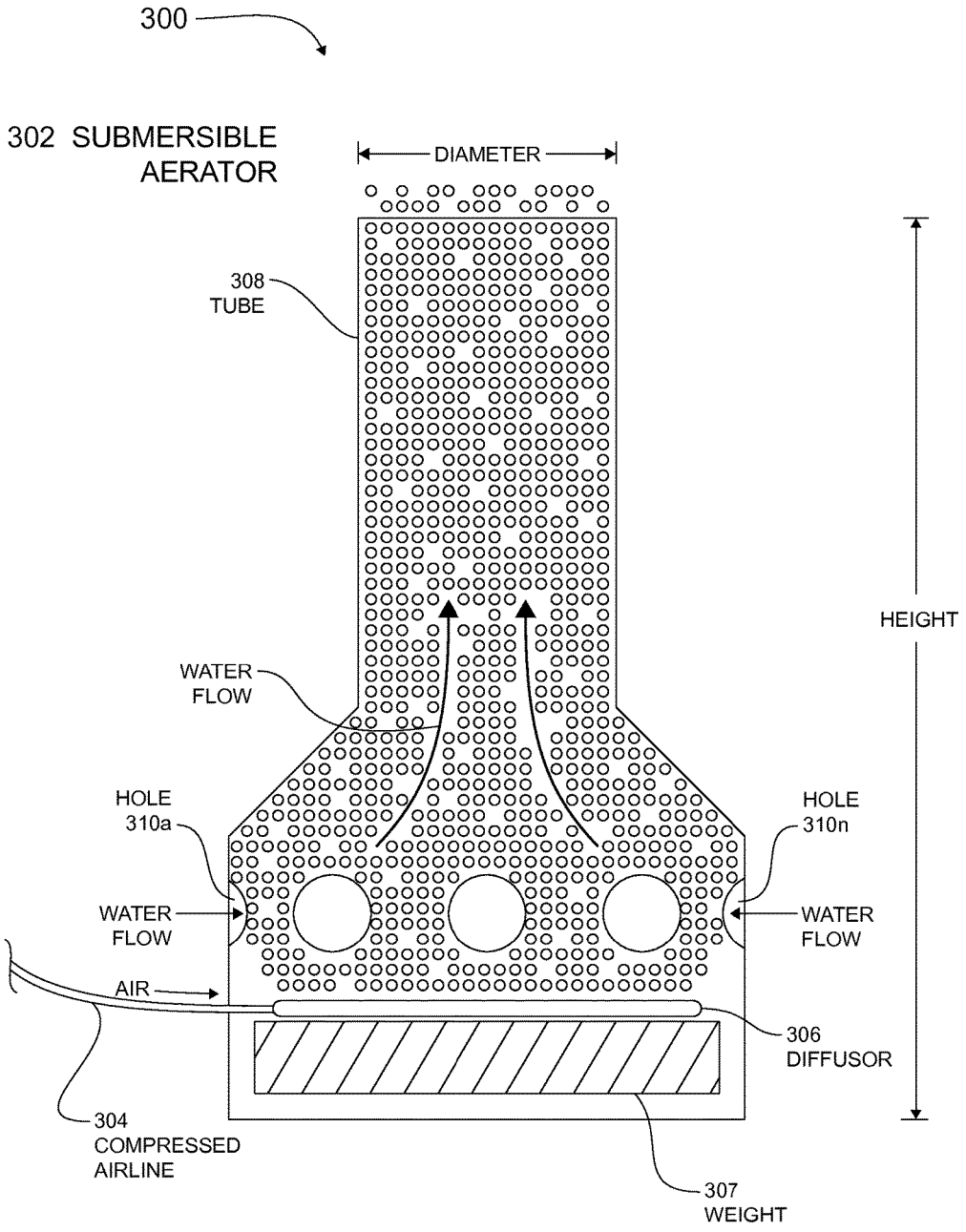
FIG. 3 is a diagram illustration of an embodiment showing a submersible aerator system.

FIG. 3 is a diagram of an embodiment 300, showing a submersible aerator. Embodiment 300 is an example of a submersible aerator that generates a laminar column of bubbles and an upward water flow.

A submersible aerator 302 may have a diffusor 306, a weight 307 and a tube 308.

The weight 307 may be used to keep the submersible aerator 302 stable and submerged in a body of water.

The diffusor 306 may be one of many types of diffusors. One type of bubble diffusor may use an expandable membrane diffusor made of perforated rubber. Other types of diffusors may include ceramic or metal stone diffusors.

The submersible aerator 302 may be connected to a compressor. The compressor may provide air to the diffusor 306 via a compressed airline 304. The compressed airline 304 may be connected to the diffusor 306. Depending on the air pressure provided by the compressor, the diffusor 306 may produce a laminar flow of bubbles. At higher pressures, the diffusor 306 may produce turbulent or slug flow.

The tube 308 may be used to pull water into the bubble stream created by the diffusor 106. The tube 308 may act as a venturi tube. The combination of the diffusor 306 and venturi tube 308 may create a laminar column of water that draws water from the bottom of the tube.

The diameter of the tube 308 may be varied. For instance, one embodiment may have an internal diameter of four inches for the tube 308. Other embodiments may have tube diameters that are less than or greater than four inches. Some embodiments may have tube diameters of 6, 8, 10, 12, 18, or more inches.

The height of the tube 308 may also be changed in different embodiments of the submersible aerator 302. For instance, the height of the tube 308 may be two times the internal diameter of the tube 308. In another instance, the height of the tube 308 may be more than three times the internal diameter of the tube 308. Other embodiments may have tube heights that are 4, 5, 8, 10, or more times the internal diameter of the tube 308. The height of the tube 308 may be based on a depth of a body of water.

Near the base of the submersible aerator 302, there may be a plurality of holes **310*a*-310*n*. Water may be drawn through the holes 310*a*-310*n* into the tube 308. The bubbles created by the diffusor 306 may push the water in an upward direction. By drawing water in thru the holes 310*a*-310*n*, the submersible aerator 302** may draw in water at the level of the holes and thus control from what depth the water may be drawn.

The submersible aerator 302 may help circulate and oxygenate a body of water.

Figure 4:
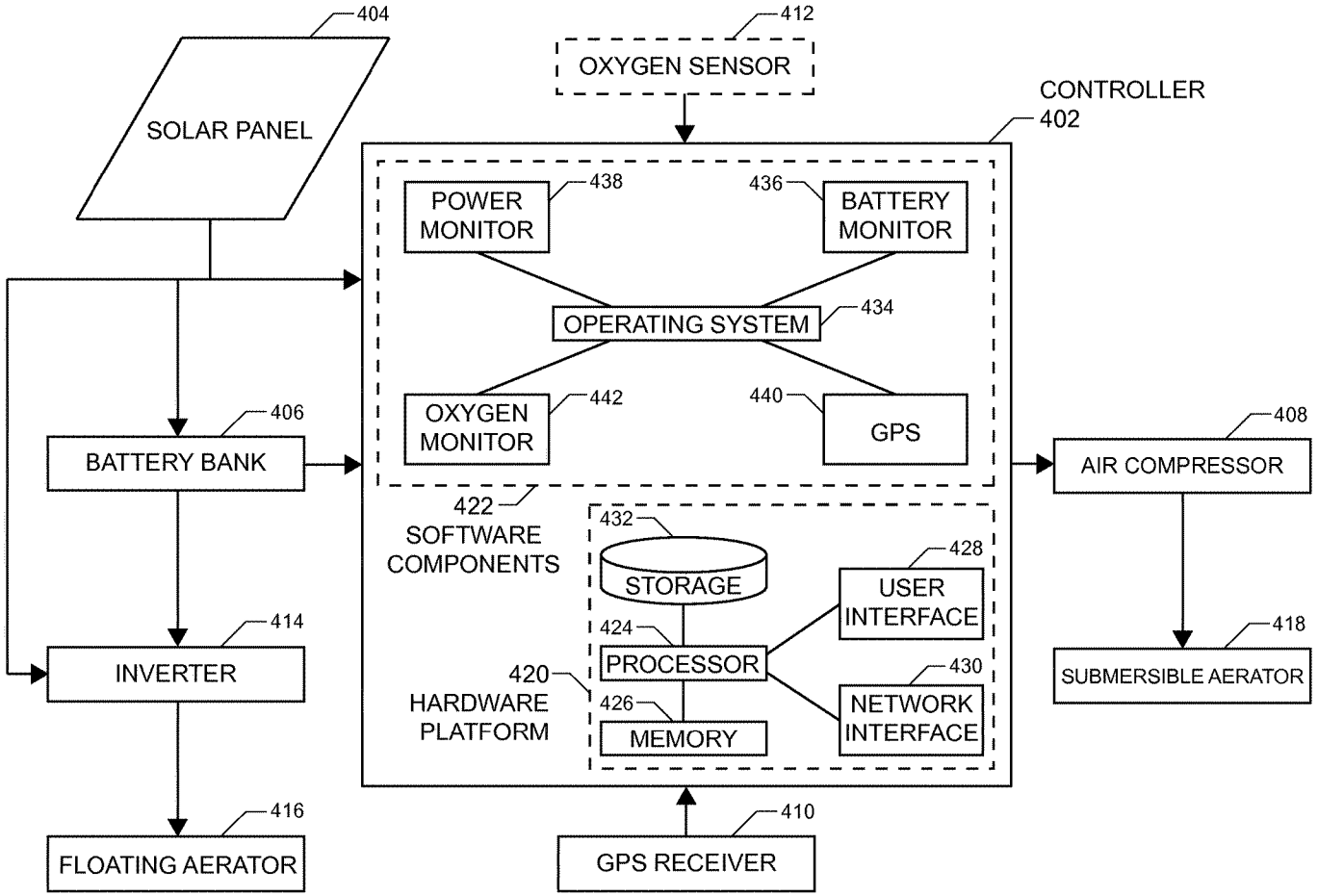
FIG. 4 is a diagram illustration of an embodiment showing a controller operated system.

FIG. 4 is a block diagram of an embodiment 400 showing a system that may have a controller configured to operate a submersible aerator and a floating aerator. Embodiment 400 is one example of a configuration used to operate the submersible aerator and floating aerator.

Embodiment 400 shows an example architecture that contains different functional elements. The diagram of FIG. 4 illustrates functional components of a system. In some cases, the component may be a hardware component, a software component, or a combination of hardware and software. Some of the components may be application level software, while other components may be operating system level components. In some cases, the connection of one component to another may be a close connection where two or more components are operating on a single hardware platform. In other cases, the connections may be made over network connections spanning long distances. Each embodiment may use different hardware, software, and interconnection architectures to achieve the described functions.

The system may be used to aerate a body of water. The system may be powered by solar energy when it is daytime and a battery when it is nighttime. The combination of solar power and battery power may keep the system operating continuously when off an electrical power grid. To keep the system continuously operating and the body of water aerated, a controller may be used to determine when to run components and at what capacity to run the components.

The controller may operate components of the system based on a variety of factors. The factors may be related to the energy available to the system, the oxygen content in a body of water where the system is located, or other factors. In some instances, a geographical location and time of day may change how the controller operates the system. The controller may use factors or a combination of factors to determine how the system operates. The controller may control multiple aerators. Embodiment 400 illustrates a system that may have one floating aerator and one submersible aerator. Other embodiments may have multiple aerators and other mechanisms that may move water around a pond, lake, or other body of water. A controller may cause all of the aerators and other mechanisms to operate simultaneously, in sequence, or in other ways to respond to meet desired oxygen levels, reduce stratification, increase mixing, or to perform other functions.

A solar powered system may operate a subset of the aerators when the solar collection system is receiving less power due to clouds, when the system may be recharging a battery pack, or for other circumstances. In some embodiments, one type of aerator may consume more energy than another type of aerator. For example, a compressed air powered submersible aerator may consume much less energy than an electric floating aerator that creates a splashing fountain. In such an example, a controller may prefer to operate the submersible aerators during periods of lower power levels while turning off the floating aerators or possibly operating the floating aerators intermittently.

In another example, a controller may be connected to eight sets of submersible and floating aerator combinations. During a period of low power, the controller may operate two sets of aerator combinations at a time, and may cycle through each set of aerator combinations for a period of time. As power levels increase, the controller may operate four sets of aerator combinations and when the solar power has reached maximum, the controller may operate all of the aerators simultaneously. Many different options and programming sequences may be used as well.

The solar panel 404 may power all of the components of the system 400. A battery bank 406 charged by the solar panel 404 may be used when the solar panel 404 is not generating power. While the system 400 is operating in daylight, the solar panel 404 may keep the battery bank 406 fully charged. Depending on the power consumption of the system 400, the battery bank 406 may be sized based on a particular system or usage. For instance, more batteries may be added to the battery bank 406 when the solar energy input is highly variable, such as in climates with high amounts of rain. Alternatively, during the winter months when days are shorter and there is less sunlight, more batteries may be used.

A Global Positioning System (GPS) receiver 410 may generate a location and a time of the system 400. The controller 402 may use the GPS input to determine what conditions the system 400 may be operating and how to compensate for those conditions. One example of the conditions may be to determine whether sunlight may be expected at a particular time. When sunlight is expected and very little power is generated by the solar panel 404, the controller may determine that the weather is cloudy.

An oxygen sensor 412 may determine the amount of oxygen in a body of water. The oxygen sensor 412 may be placed in a body of water and may transmit a signal that contains oxygen levels to the controller 402. The controller 402 may use the signal from the oxygen sensor 412 to determine when and how to aerate a body of water. At periods of low oxygen levels, the controller 402 may operate a more effective aerator for a longer period of time.

An inverter 414 may be included to operate components that run on a different energy than the energy generated by the solar panel 404. For instance, the inverter 414 may be used to convert direct current (DC) electricity to alternating current (AC) electricity. The inverter 414 may be connected to the solar panel 404 and the battery bank 406.

The system 400 may include a floating aerator 416 used to agitate and aerate an upper portion of a body of water. To aerate a lower portion of a body of water, an air compressor 408 connects to a submersible aerator 418.

The controller 402 may have a hardware platform 420 and software components 422.

The controller 402 may represent any type of programmable controller device. In some embodiments, the controller 402 may be any type of computing device, such as a personal computer, industrial controller, ladder logic controller, or other computing device.

The hardware platform 420 may include a processor 424, random access memory 426, and nonvolatile storage 432. The processor 424 may be a single microprocessor, multicore processor, or a group of processors. The random access memory 426 may store executable code as well as data that may be immediately accessible to the processor 424, while the nonvolatile storage 432 may store executable code and data in a persistent state.

The hardware platform 420 may include user interface devices 428. The user interface devices 428 may include keyboards, monitors, pointing devices, and other user interface components. In some embodiments, the user interface devices 428 may be used for programming and maintenance, but may not be present for normal operations.

The hardware platform 420 may also include a network interface 430. The network interface 430 may include hardwired and wireless interfaces through which the controller 402 may communicate with other devices.

The software components 422 may include an operating system 434 on which various applications may execute. In some cloud based embodiments, the notion of an operating system 434 may or may not be exposed to an application.

The software components 422 may include a battery monitor 436 that may determine the amount of charge in the battery bank 406. The battery monitor 436 may cause the battery bank 406 to be charged when the solar panels 404 are generating more electricity than the remainder of the system is consuming.

The software components 422 may include a power monitor 438 that may determine the amount of energy the solar panel 404 is generating. The power monitor 438 may operate in conjunction with the battery monitor 436 to charge the battery bank 406. The power monitor 438 may also be used to determine power availability, which may be used to determine which aerators to operate and for what period of time.

The software components 422 may include a Global Positioning System input 440 that may receive a signal from the GPS receiver 410. The signal from the GPS receiver 410 may indicate a time and a location of the GPS receiver 410. The input from the GPS receiver 410 may be used to determine the weather. For example, a controller may compare the power received from the power monitor 438 with the expected sunlight determined from the GPS receiver 410 to determine the weather to be overcast or cloudy.

The software components 422 may further include an oxygen monitor 442 that may receive a signal from the oxygen sensor 412 with the current oxygen levels of a body of water. The oxygen monitor 442 may provide instantaneous or historical records of the oxygen levels in the body of water.

The controller 402 may determine when to operate the submersible aerator 418 and the floating aerator 416 based on a variety of factors. The factors may be related to the energy available from the solar panel 404 and the battery bank 406. In some instances, the oxygen sensor 412, weather, or other factors may be used to determine which aerators to operate and when to do so.

For instance, the controller 402 may operate the submersible aerator 418 and the floating aerator 416 based on an energy available from the solar panel 404. Because the power level of the battery bank 406 and the solar panel 404 may vary based on the weather and time of day, the controller 402 may operate the various aerators at different times or for different amounts of time.

In some embodiments, one type of aerator may consume less energy than another type of aerator. The controller 402 may operate aerators that have low energy consumption on days where the solar panel 404 generates a low amount of energy, such as days that are cloudy.

In some embodiments, the controller 402 may prioritize recharging the battery bank 406 depending on the charge on the battery bank 406. In such a prioritized mode, the controller 402 may operate a low consumption aerator until the battery bank 406 reaches a predetermined charge level, then the controller 402 may begin operating additional aerators.

The controller 402 may have different programs to address specific issues in a body of water. In conditions where the water may be poorly oxygenated, the controller 402 may have a program that prefers to operate the floating aerator 416 over the submersible aerator 418, since the floating aerator 416 may deliver more oxygen to the water than the submersible aerator 418. In conditions where the body of water may have significant strata and may not be well mixed, the controller 402 may have a program that prefers to operate the submersible aerator 418. In some embodiments, the controller 402 may alternate between preferring one type of aerator over another.

The preference of one aerator over the other may be implemented by operating a preferred aerator for a longer time or to consume more energy than the non-preferred aerator. In the case of a sunny day where large amounts of energy may be available, the controller may operate the preferred aerator continuously or for a longer time than the non-preferred aerator. In the case of a cloudy day or where little energy may be available, the controller may operate the non-preferred aerator for a short period of time or maybe not at all.

Some embodiments may have a Global Positioning System (GPS) receiver. When a GPS receiver is available, the controller 402 may determine the time, date, and location of the system 400. From this information, the controller 402 may be able to determine whether or not sunlight might be expected at any given time and, in some cases, how intense the sunlight may be due to the time of year or other factors. In one use, the expected sunlight energy received may be compared to the actual sunlight energy received from the solar panel 404 to determine whether or not the weather is sunny or cloudy.

The controller 402 may use a hierarchal structure to order the factors. For instance, a charge of the battery bank 406 may take precedence over whether it is cloudy when the controller 402 determines how to operate the system 400.

One of the factors the controller 402 may use to determine how to operate the system 400 is the amount of energy generated by the solar panel 404. The controller 402 may monitor the solar panel 404 and alter the system 400 based on the energy generated by the solar panel 404.

In one embodiment, the controller 402 may adjust the amount of time the submersible aerator 418 and the floating aerator 416 are running in response to the amount of energy the solar panel 404 is generating. For instance, the controller 402 may run the floating aerator 416 for a portion of time that the submersible aerator 418 is running.

In another embodiment, the controller 402 may adjust the capacity the submersible aerator 418 and the floating aerator 416 are running at in response to the amount of energy the solar panel 404 is generating. For instance, the controller 402 may operate the submersible aerator 418 and the floating aerator 416 at or less than 90% of full capacity.

When the system 400 is powered by the battery bank 406, the controller 402 may operate the system 400 based on a charge of the battery bank 406. If the charge of the battery bank 406 is high, the controller 402 may operate the system 400 at full capacity. When the charge of the battery bank 406 is low, the controller 402 may operate the system 400 at less than full capacity. The controller 402 may operate the system 400 at less than full capacity so that the system 400 may continuously run until the battery bank 406 is charged again.

The controller 402 may continuously monitor the battery bank 406 and alter the system 400 based on the charge of the battery bank 406. For instance, the controller 402 may lower the capacity at which the system 400 is operating at as the charge of the battery bank 406 lowers.

In one embodiment, the controller 402 may alter the power output to the floating aerator 416 when a lower threshold is reached by the battery bank 406. For example, the controller 402 may turn the floating aerator 416 off when the battery bank 406 reaches the lower threshold. The lower threshold may be predetermined before the system 400 is installed. In another embodiment, the controller 402 may turn the floating aerator 416 off so that the submersible aerator 418 may run continuously. Conversely, the controller 402 may turn the submersible aerator 418 off so that the floating aerator 416 may run continuously.

In another embodiment, when the charge of the battery bank 406 is low, the controller 402 may operate the floating aerator 416 for a portion of time the submersible aerator 418 is operated. For example, the controller 402 may run the floating aerator 416 for 10% of the time the submersible aerator 418 is running. Other embodiments may run the floating aerator 416 for less than or greater than 10% of the time the submersible aerator 418 is running. Some embodiments may run the floating aerator 416 for 15%, 25%, 50%, 75%, 90%, or more of the time the submersible aerator 418 is running.

Another one of the factors the controller 402 may use to determine how to operate the system 400 is whether it is sunny or cloudy. The GPS receiver 410 may be used by the controller 402 to determine if it is a cloudy or sunny day.

To determine if it is a cloudy day, the controller 402 may receive a signal from the GPS receiver 410. The signal from the GPS receiver 410 may be generated by an internal clock of the GPS receiver 410 that determines the time of day based on a location.

In one example, the controller 402 may determine it is daytime by receiving a signal that indicates the time is 12:00 P.M. Mountain Standard Time (MST). In another example, the controller 402 may determine it is night time by receiving a signal that indicates the time is 12:00 A.M. MST.

The controller 402 may receive the signal that contains time and location information from the GPS receiver 410. If the controller 402 determines it is daytime and the solar panel 404 is not generating energy, then the controller 402 may determine it is cloudy out. When the controller 402 determines it is a cloudy day, the controller 402 may run the system 400 at less than full capacity. The controller 402 may run the system 400 at less than full capacity so that the system 400 may run continuously. The capacity at which the system 400 is operated may be related to the amount of energy generated by the solar panel 404.

In one embodiment, the controller 402 may turn off the floating aerator 416 while it is cloudy. Other embodiments may run the floating aerator 416 at 10%, 25%, 50%, 75%, or more of full capacity. The controller 402 may return the floating aerator 416 to full capacity when the solar panel 404 is generating energy at full capacity.

The controller 402 may also factor in oxygen levels of a body of water to determine how to operate the system 400. An "acceptable" oxygen level and a "non-acceptable" oxygen level may be pre-programmed into the controller 402. The oxygen sensor 412 may be placed in a body of water, determine the oxygen level of that body of water, and send a signal to the controller 402. The signal generated by the oxygen sensor 412 may contain the oxygen level of the body of water.

Based on the oxygen level of the body of water, the controller 402 may determine how to operate the system 400. For instance, if the oxygen level is "acceptable", the controller 402 may continue to operate the system 400 based on the other factors. When the oxygen level is "non-acceptable", the controller 402 may run the system 400 at full capacity.

To continuously aerate the body of water, the controller 402 may use a variety of factors to determine how to operate the system 400. Based on the energy available to the system 400 or the oxygen levels of a body of water, the controller 402 may alter the operation of the system 400 so that the system 400 may continuously aerate and oxygenate.

Figure 5:
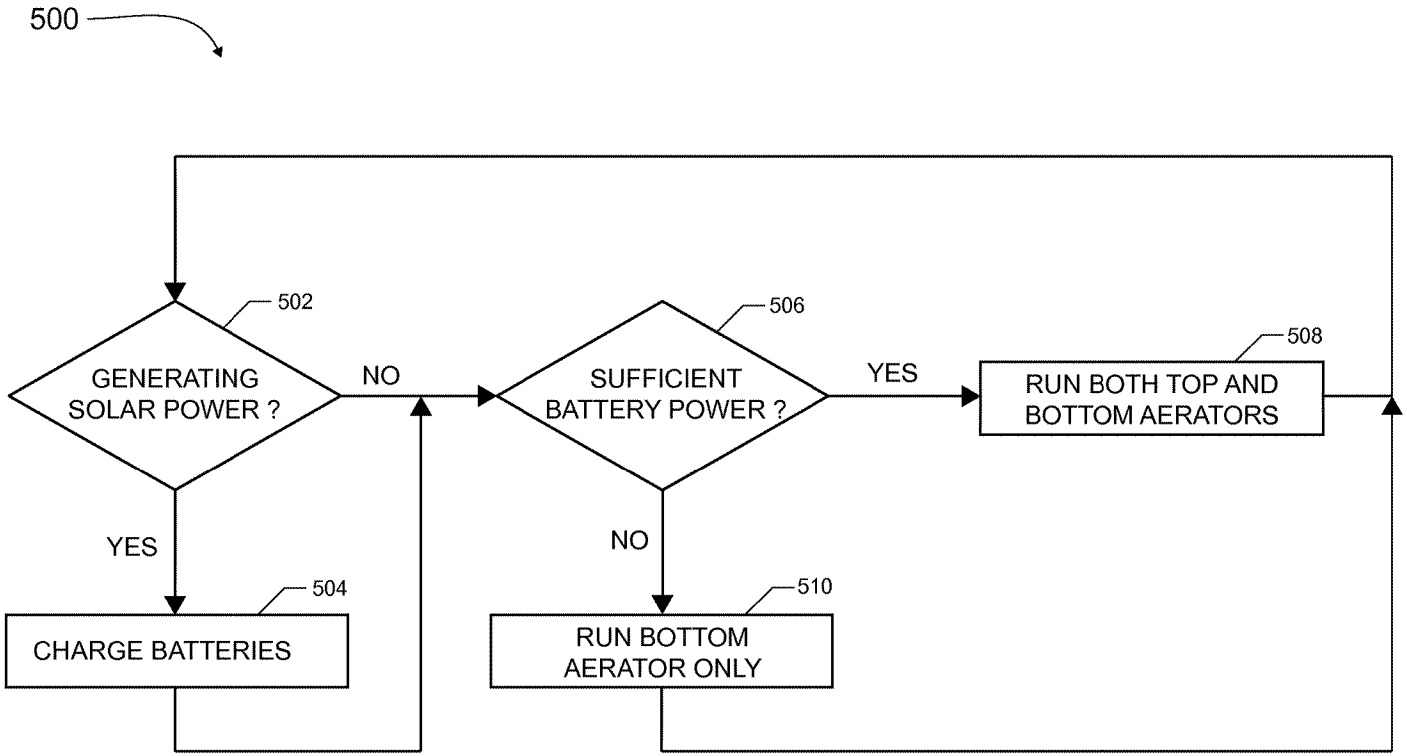
FIG. 5 is a flowchart illustration of an embodiment showing a process for operating a two aerator system.

FIG. 5 is a flowchart illustration of an embodiment 500 showing a method for operating an aeration system. Embodiment 500 is a simplified example of a method that may be performed by a controller, such as the controller 402 of embodiment 400. The process of embodiment 500 is a simplified example of one method by which the controller may determine when to operate a submersible aerator and a floating aerator.

Other embodiments may use different sequencing, additional or fewer steps, and different nomenclature or terminology to accomplish similar functions. In some embodiments, various operations or set of operations may be performed in parallel with other operations, either in a synchronous or asynchronous manner. The steps selected here were chosen to illustrate some principles of operations in a simplified form.

In block 502, a check of a power monitor may be made to determine if solar power is being generated.

When solar power is generating, the process may move to block 504. In block 504, the power generated by the solar panel may charge batteries.

The process may move to block 506 if solar power is not being generated or after the batteries are charged. In block 506, a battery power level may be evaluated. If the power level is above a predefined threshold, the top and bottom aerators may be run in block 508. If the power level is below the predefined threshold, the bottom aerator may only be run in block 510.

The process may return to block 502 and repeat. The controller may continuously go through the process of embodiment 500.

Figure 6:
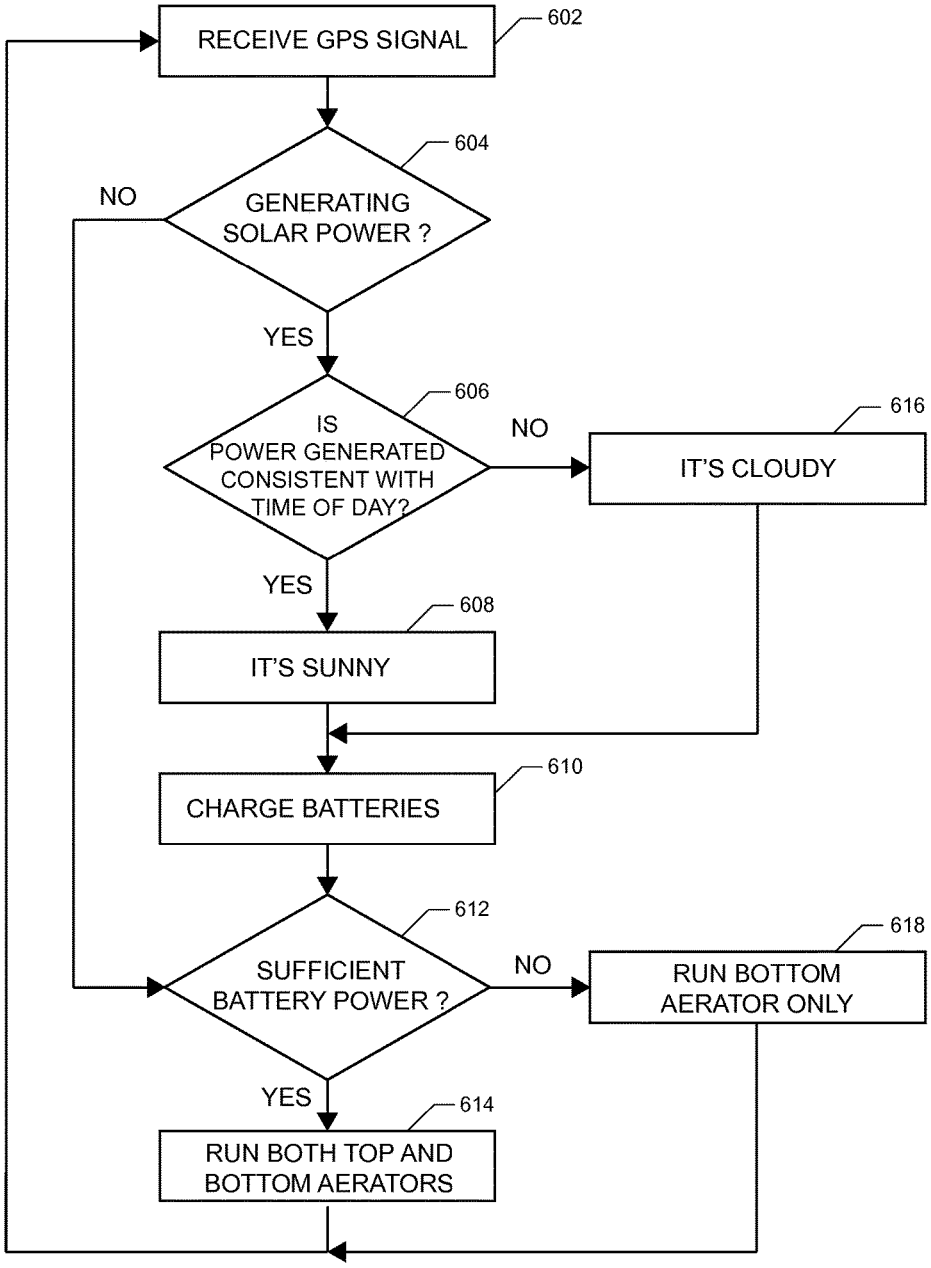
FIG. 6 is a flowchart illustration of an embodiment showing an alternative process for operating a two aerator system.

FIG. 6 is a flowchart illustration of an embodiment 600 showing a method for operating an aeration system. Embodiment 600 is a simplified example of a method that may be performed by a controller, such as the controller 402 of embodiment 400. The process of embodiment 600 is a simplified example of one method by which the controller may determine when to operate a submersible aerator and a floating aerator.

Other embodiments may use different sequencing, additional or fewer steps, and different nomenclature or terminology to accomplish similar functions. In some embodiments, various operations or set of operations may be performed in parallel with other operations, either in a synchronous or asynchronous manner. The steps selected here were chosen to illustrate some principles of operations in a simplified form.

In block 602, a signal from a global positioning system (GPS) receiver may be received. In some embodiments, the controller may receive the signal which contains time and location information. Based on the time and location provided by the GPS signal, the controller may determine it should be light or dark out.

In some embodiments, a GPS receiver may not be available. In such embodiments, a controller may have a time signal or other information from which a controller may determine whether or not sunlight may be expected at that time.

In block 604, a power monitor may be evaluated to determine if solar power is being generated.

If solar power is not being generated, the process may move to block 612. When solar power is being generated, the process may move to block 606. In block 606, a comparison may be made to determine if the power generated is consistent with the time of day. For instance, a controller might expect higher energy generation during the day than at night. The controller may be pre-programmed with expected power levels to compare with actual power levels of a solar panel.

When the power generated is consistent with the time of day, the process may move to block 608. In block 608, a controller may determine that the weather is sunny.

When the power generated is not consistent with the time of day, the process may move to block 616. A controller may determine the weather is cloudy in block 616. The controller may operate aerators based on the weather. The controller may devote less energy to aerators when the weather is cloudy and more energy to aerators when the weather is sunny. For instance, the controller may operate aerators that consume less energy when the weather is cloudy.

The process may move to block 610 whether the weather is sunny or cloudy. In block 610, batteries may be charged. Embodiment 600 is configured to charge the batteries as a priority over operating any aerators. Energy may be first devoted to recharging the batteries, then any excess energy may be used to operate aerators. As the batteries reach their energy storage capacity, the aerators may be operated at a higher energy-consuming manner.

After charging batteries, the process may move to block 612.

In block 612, a battery monitor may be evaluated to determine a power level of the batteries. When the power level is above a predefined threshold, a top aerator and a bottom aerator may be run in block 612.

When the power level is below the predefined threshold, the bottom aerator may only be run in block 618.

Embodiment 600 may be implemented in a system with several sets of top and bottom aerator combinations. During a period of low power, a controller may operate a subset of aerator combinations at a time, and may cycle through each subset of aerator combinations for a period of time. As power levels increase, the controller may operate a larger subset of aerator combinations and when the power has reached a maximum, the controller may operate all of the aerators simultaneously.

The process 600 may return to the block 602 and start over again. The controller may continuously go through the process of embodiment 600.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A liquid aeration system for aerating a body of water comprising:

a submerged aerator that is located in a submerged location in said body of water;

a diffuser selected from the group consisting of an expandable rubber membrane diffuser, a ceramic diffuser, an aluminum silicate diffuser, a synthetic rubber membrane diffuser and a metal stone diffuser, said diffuser disposed in said submerged aerator that is connected to said compressor;

a compressor that generates a source of compressed air that is supplied to said diffuser, said source of compressed air having a pressure that creates a laminar flow of bubbles in said body of water when passing through said diffuser;

a solar collector that generates electricity;

a battery pack that stores said electricity that is generated by said solar collector;

a tube that directs said laminar flow of bubbles in said tube to a create a laminar flow of bubbles in said body of water, said laminar flow of bubbles creating a columnar flow of water from said submerged location in said body of water;

a floating aerator that is aligned with said laminar flow of bubbles and said columnar flow of water;

a motor disposed in said floating aerator;

a propeller connected to said motor that rotates said propeller in response to rotation of said motor, said propeller located at a certain depth that causes said propeller to draw said flow of water from said submerged location and propel water upwards above a surface portion of said body of water so that propelled water splashes and is aerated on said surface portion of said body of water;

a controller that is connected to said solar collector, said battery pack, said floating aerator and said submerged aerator that controls operation of said battery pack, said floating aerator and said controller operates said submerged aerator and said floating aerator based on energy stored in said battery pack.

2. The system of claim 1 further comprising:

weights that anchor said floating aerator above said submerged aerator.

3. The system of claim 1 further comprising:

couplers that couple said floating aerator to said submerged aerator.

4. The system of claim 3 wherein said submerged aerator floats under said floating aerator.

5. The system of claim 2 further comprising a weight disposed in said submerged aerator that anchors said submerged aerator to a bottom portion of said body of water.

* * * * *